US009555516B2

(12) United States Patent
Brown et al.

(10) Patent No.: US 9,555,516 B2
(45) Date of Patent: Jan. 31, 2017

(54) METHOD FOR PROCESSING AN EDGE OF A GLASS PLATE

(75) Inventors: James W. Brown, Painted Post, NY (US); Tadashi Kitamura, Hamamatsu (JP); Gautam N. Kudva, Horseheads, NY (US); Siva Venkatachalam, Painted Post, NY (US)

(73) Assignee: CORNING INCORPORATED, Corning, NY (US)

( * ) Notice: Subject to any disclaimer, the term of this patent is extended or adjusted under 35 U.S.C. 154(b) by 2118 days.

(21) Appl. No.: 12/508,762

(22) Filed: Jul. 24, 2009

(65) Prior Publication Data

US 2011/0021116 A1 Jan. 27, 2011

(51) Int. Cl.
*B24B 9/10* (2006.01)
*B24B 41/06* (2012.01)

(52) U.S. Cl.
CPC ..... *B24B 9/10* (2013.01); *B24B 41/068* (2013.01)

(58) Field of Classification Search
CPC ..... B24B 9/08
USPC ..... 451/41, 43, 44, 57, 58, 11, 55
See application file for complete search history.

(56) References Cited

U.S. PATENT DOCUMENTS

| | | | | |
|---|---|---|---|---|
| 4,228,617 | A | 10/1980 | Bando | 51/3 |
| 4,954,814 | A * | 9/1990 | Benge | 340/572.3 |
| 5,265,382 | A | 11/1993 | Park et al. | 51/283 |
| 5,713,784 | A | 2/1998 | Miller | 451/65 |
| 5,738,563 | A | 4/1998 | Shibata | 451/5 |
| 5,816,897 | A | 10/1998 | Raeder et al. | 451/44 |
| 6,325,704 | B1 | 12/2001 | Brown et al. | 451/44 |
| 6,676,488 | B2 | 1/2004 | Brown et al. | 451/41 |
| 6,685,541 | B2 | 2/2004 | Brown et al. | 451/41 |
| 7,001,249 | B1 * | 2/2006 | Pride et al. | 451/21 |
| 7,018,272 | B2 | 3/2006 | Allaire et al. | 451/11 |
| 7,134,936 | B2 * | 11/2006 | Gariglio | 451/11 |
| 2004/0209557 | A1 | 10/2004 | Gariglio | |
| 2007/0197120 | A1 | 8/2007 | Lee | |
| 2010/0305237 | A1 | 12/2010 | Suemura et al. | |

FOREIGN PATENT DOCUMENTS

| | | | |
|---|---|---|---|
| JP | 1177501 | A | 7/1989 |
| JP | 2011/077500 | A | 9/1997 |
| JP | 2011/271739 | A | 3/1998 |
| JP | 2000/202749 | | 1/1999 |
| JP | 08-266046 | | 11/2008 |

(Continued)

OTHER PUBLICATIONS

CN201010249922.8 Office Action Dated Feb. 25, 2013.
TW099124372 Search Report Dated Nov. 3, 2015.

*Primary Examiner* — Robert Rose
(74) *Attorney, Agent, or Firm* — Kevin M. Able

(57) ABSTRACT

A method for beveling a thin glass plate by simultaneously grinding an edge of the glass using multiple abrasive cup wheels, wherein the edge of the glass plate is extended from the fixturing device. The extension of the glass plate allows the glass plate to bend in response to forces applied by the abrasive cup wheels, thereby reducing the sensitivity of the grinding process to variations in position of the abrasive wheels. The axes of rotation of the abrasive wheels are separated by a distance selected to prevent deflection in the glass plate caused by a first abrasive wheel to influence the deflection in the glass plate caused by a second (adjacent) abrasive wheel.

19 Claims, 5 Drawing Sheets

(56) References Cited

FOREIGN PATENT DOCUMENTS

| | | | |
|---|---|---|---|
| TW | 200708488 | | 3/2007 |
| TW | 200904590 | A | 2/2009 |
| WO | 2008/020509 | A1 | 2/2008 |

* cited by examiner

METHOD FOR PROCESSING AN EDGE OF A GLASS PLATE

TECHNICAL FIELD

This invention is directed to a method of processing a glass plate, and in particular shaping an edge of the plate.

BACKGROUND

Glass plate manufacturing comprises three principal steps, melting of the raw material to form a molten glass, forming the molten glass into sheets or plates and finally processing the plate into a final shape satisfactory to purchaser or user. Methods of forming thin glass plates include an overflow downdraw process, or fusion process, wherein a molten glass is supplied to an open-top conduit. The molten glass overflows the conduit and flows down converging surfaces comprising the outer surface of the conduit. At the bottom of the conduit the separate flows rejoin, or fuse, to form a thin glass ribbon. Other methods include the well known float process, where molten glass is floated on a bath of usually tin, slot draw, up draw and others. Generally, all of these processes include a final processing step of separating individual plates of glass from a parent sheet, sizing the plates in a cutting operation and edging the glass to strengthen the piece for subsequent handling operations. The individual plates are edged both to remove flaws that may be formed when individual plates are cut from the parent, and to eliminate sharp edges that are easily damaged during handling.

Thin plate glass edging is typically done using a grinding wheel consisting of formed grooves. These formed grooves will create a shape on the glass that mirrors the groove. An example of this process is documented in U.S. Pat. No. 6,685,541 to Brown, et al. and U.S. Pat. No. 6,325,704 Brown, et al.

As the need for ever thinner plates of glass increases, owing largely to the electronic display industries (computers, cell phones, digital cameras and the like), producing a consistent edge shape in the wheel is becoming increasingly difficult:

the wheel profile becomes misshapen with use, causing inconsistent plate edge shape;

the surface area used by the wheel is limited to the groove, which increases the cost due to poor utilization of material;

the relatively small surface area of the wheel actually contacting the glass necessitates the use of coarser abrasive grain sizes and, ultimately, poorer glass sheet surface finishes;

the lack of chip clearance between the glass and the wheel during grinding increases the potential for defects in the plate as the wheel becomes clogged by glass particles; and wheel profiles are difficult to make when a small tight radius is required. Formed wheels are typically made using an EDM process. As the tool used to create the form wears, often quickly, it creates an undesirable blunt profile at the bottom of the resultant groove.

The edging process generates particulate (e.g. chips), which is often difficult to remove from the plates.

SUMMARY

In one embodiment, a method of shaping the edge of a glass plate is described comprising coupling a glass plate to a holding fixture, a portion of the glass plate extending from the holding fixture a distance L and comprising a first surface, a second surface opposing the first surface and an end surface, and wherein the first surface and the end surface intersect along a first edge and the second surface and the end surface intersect along a second edge, contacting the first edge with a first abrasive cup wheel rotating about a first axis of rotation angled relative to the first surface, wherein the first abrasive cup wheel contacts the first edge with a first force $F_1$ that produces a first displacement $\delta_1$ of the extended portion, contacting the second edge of the glass plate with a second abrasive cup wheel rotating about a second axis of rotation angled relative to the second surface and spaced apart from the first abrasive cup wheel axis of rotation by a distance D, the second abrasive cup wheel contacting the second edge with a second force $F_2$ that produces a second displacement $\delta_2$ of the extended portion opposite from $\delta_1$, and wherein the second abrasive cup wheel contacts the second edge simultaneous with the first abrasive cup wheel contacting the first edge, producing relative motion between the first and second abrasive cup wheels and the glass plate during the contacting of the first and second abrasive cup wheels with the first and second edges, respectively, and wherein the first displacement does not overlap the second displacement. Preferably, there is no relative motion between the first and second abrasive cup wheels during the contacting of the first and second abrasive cup wheels with the first and second edges, respectively. D is preferably equal to or greater than 220 mm, preferably equal to or greater than 250 mm, preferably greater equal to or greater than 275 mm or preferably equal to or greater than 300 mm. L is preferably equal to or greater than 10 mm, preferably equal to or greater than 25 mm, and more preferably L is equal to or greater than 50 mm, although in some instances, such as when the thickness of the glass plate is very small (e.g. less than about 0.3 mm), L may be as small as 5 mm. In some embodiments, the edges produced by the beveling may be further polished.

In certain other embodiments, an edge of the fixturing device may be shaped such that L, the amount of extension of the glass plate, varies relative to the edge of the fixturing device (support). The fixture may, for example, comprise an edge proximate the extended portion that includes a nonlinear shape. The nonlinear shape may be a curve, or the nonlinear shape may be a combination of linear segments.

In some embodiments, a distance between the first abrasive wheel and the first edge is varied, respectively, to maintain a constant bevel width and supplement the compliance of extended portion of the glass plate.

In another embodiment, a method of shaping the edge of a glass plate is disclosed comprising coupling a glass plate having a thickness equal to or less than 2 mm to a holding fixture, a portion of the glass plate extending from the holding fixture a distance L and comprising a first surface, an second surface opposing the first surface and an end surface, wherein the first surface and the end surface intersect along a first edge and the second surface and the end surface intersect along a second edge, contacting the first edge with a first abrasive cup wheel rotating about a first axis of rotation angled relative to the first surface, wherein the first abrasive cup wheel contacts the first edge with a first force $F_1$ that produces a first displacement in the extended portion, contacting the second edge of the glass plate with a second abrasive cup wheel rotating about a second axis of rotation angled relative to the second surface and spaced apart from the first abrasive cup wheel axis of rotation by a distance D, the second abrasive cup wheel contacting the second edge with a second force $F_2$ that produces a second displacement in the extended portion opposite in direction from the first displacement, and wherein the second abrasive cup wheel contacts the second edge simultaneous with the first abrasive cup wheel contacting the first edge, producing relative motion between the first and second abrasive cup wheels and the glass plate during the contacting of the first and second abrasive cup wheels with the first and second edges, respectively and wherein the extended portion extends a distance L equal to or greater than 25 mm from the holding fixture and D is selected such that the first displacement does not overlap the second displacement.

An included angle formed by the intersection of the planes of the bevels is preferably between about 40 and 140 degrees.

In some embodiments, edges formed by the beveling process may subsequently be polished to remove their sharpness and avoid cracking that may occur if the sharp bevel-produced edges are contacted.

To vary the stiffness of the extended portion, and therefore its flexure resulting from contact with the grinding wheels, L may vary as a function of position along the first or second edge. Preferably, L in the range between 5 mm and 50 mm.

D may be selected to be equal to or greater than 220 mm, preferably equal to or greater than 275 mm, and in some cases equal to or greater than about 300 or 320 mm.

In still another embodiment an apparatus for grinding bevels in a glass plate is described, the glass plate comprising substantially parallel major surfaces and at least one end surface intersecting the major surfaces along substantially parallel first and second edges. The apparatus comprises first and second grinding wheels comprising substantially flat grinding surfaces, wherein the grinding surfaces are positioned at angles relative to the end surface of the glass plates to produce a bevel along each of the first and second edges of the glass plate, the first and second grinding wheels configured to rotate about first and second axes of rotation, respectively. The apparatus further comprises a support member (e.g. a vacuum chuck) that supports the glass plate so that a portion of the glass plate extends beyond the support member and allows the glass plate to flex in response to contact with the first and second edges by the first and second grinding surfaces, respectively, the extended portion comprising the first and second edges. The first and second axes of rotation are separated by a distance such that a deflection of the extended portion of the glass plate resulting from contact between the first grinding surface and the first edge does not affect deflection of the extended portion of the glass plate resulting from contact between the second grinding surface and the second edge, and wherein the contact between the first and second grinding surfaces and the first and second edges is concurrent.

The glass plate is preferably supported in a manner such that a stiffness of the extended portion varies as a function of location along a length of the first or second edge. In some embodiments, the distance the extended portion extends from the support varies as a function of location along a length of the first or second edge.

The invention will be understood more easily and other objects, characteristics, details and advantages thereof will become more clearly apparent in the course of the following explanatory description, which is given, without in any way implying a limitation, with reference to the attached Figures. It is intended that all such additional systems, methods, features and advantages be included within this description, be within the scope of the present invention, and be protected by the accompanying claims.

BRIEF DESCRIPTION OF THE DRAWINGS

FIG. 8 is a plot of the average deflection (circles), maximum deflection (triangles) and minimum deflection (squares) for a glass plate having a nominal overhang of 25 mm, and a glass plate having a nominal deflection of 50 mm, and the change in deflection of the end of the glass plate for small changes in the position of the abrasive wheel applying the deflecting force in.

DETAILED DESCRIPTION

Figure 1:
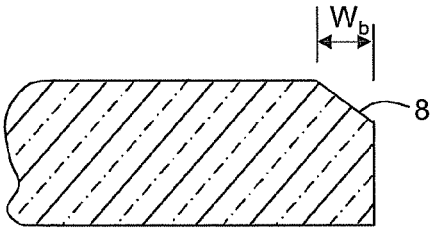
FIG. 1 is a cross sectional side view of a portion of a glass plate comprising a bevel and showing the bevel width.

In the following detailed description, for purposes of explanation and not limitation, example embodiments disclosing specific details are set forth to provide a thorough understanding of the present invention. However, it will be apparent to one having ordinary skill in the art, having had the benefit of the present disclosure, that the present invention may be practiced in other embodiments that depart from the specific details disclosed herein. Moreover, descriptions of well-known devices, methods and materials may be omitted so as not to obscure the description of the present invention. Finally, wherever applicable, like reference numerals refer to like elements.

Thin glass plates supplied to equipment manufacturers such as electronic display manufacturers typically comprise processed edges. That is, the edges are ground and shaped (e.g. beveled) to eliminate sharp edges that are easily damaged and edge flaws (chips, cracks, etc.) resulting from the cutting process that can decrease the strength of the glass. Such plates are typically equal to or less than about 2 mm in thickness between the opposing major surfaces of the plate, and more preferably a thickness equal to or less than about 0.7 mm and in some applications a thickness equal to or less than about 0.5 mm. Very thin plates of glass can be equal to or less than 0.3 mm and still be afforded the benefits of the present invention.

It is known that the fracture of glass can be traced to an initial flaw, for example a small crack, and the fracture extends from this initial flaw. Fracture can occur spontaneously over a very short period of time, or incrementally over an extended period of time depending on the stresses present in the article. Nevertheless, each fracture began at a flaw, and flaws are most typically found along the edge of a glass plate, and most especially an edge that has been previously scored and cut. To eliminate edge flaws, the plate edges may be ground or polished so that only the smallest flaws remain, thereby increasing the strength of the sheet by increasing the stress necessary to propagate a flaw.

On the other hand, grinding of the glass forms glass particulate. This particulate is often difficult to remove from the glass surfaces, even with washing. Thus, there is a competing desire to minimize the amount of material that is removed from the glass (ground away), while still minimizing sharp edges and flaws. Referring to FIG. 1 there is shown an exemplary end portion of a glass plate comprising a single bevel 8. The amount of particulate generated during grinding of bevel 8, characterized by the bevel width, $W_b$, should be minimized. The bevel width is defined as the length of the ground surface from the edge face of the glass plate that intersects the bevel.

Additionally, the grinding process itself is rarely uniform, as the abrasive wheel may have a certain play or variation in its position as it traverses the glass edges. That is, the abrasive wheel may move closer or farther from the glass plate so that the force exerted against the plate by the grinding wheel may vary both as a function of time and/or position. This positional variation may lead directly to changes in the amount of material removed from an edge. The variation can result in uneven grinding and changes in the amount of particulate produced. More simply, the bevel width may vary, and this variation is most acute if the plate edge undergoing grinding is rigid.

Figure 2A:
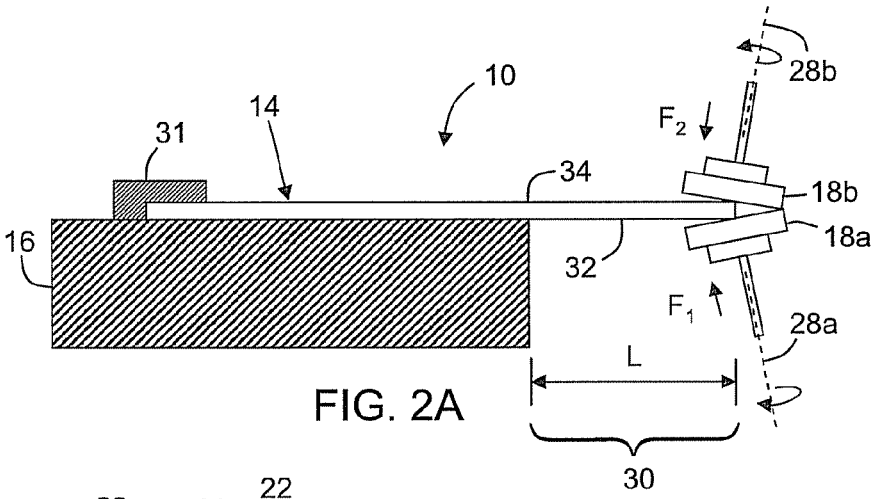
FIG. 2A is a cross sectional side view of an apparatus for processing (e.g. beveling) an edge of a glass plate.

Shown in FIG. 2A is an embodiment of an apparatus 10 for processing a thin glass plate 14 comprising support member 16. Apparatus 10 further comprises first abrasive wheel 18*a* and second abrasive wheel 18*b*. As each abrasive wheel is preferably identical to the other abrasive wheel, unless otherwise indicated, the following description will be in respect of an exemplary abrasive wheel 18 (FIG. 3).

Figure 3:
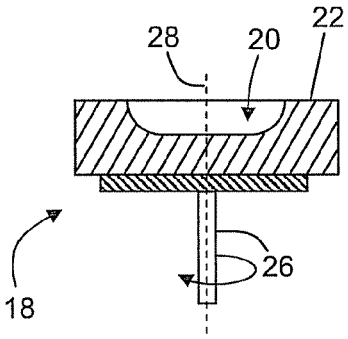
FIG. 3 is a cross sectional side view of a abrasive cup wheel used to produce a bevel such as the bevel of FIG. 1.

As shown in FIG. 3, exemplary abrasive wheel 18 is a circular wheel including a recessed center region 20. Such wheels are generally referred to as "cup" wheels based on the cup-like shape of the abrasive wheel. Abrasive wheel 18 further comprises outer annular surface 22 that serves as the grinding surface. The grinding surface is preferably flat. This is to be compared with "formed" grinding wheels (see FIG. 4) that comprise a groove or recessed region 24 in an edge of the wheel having a profile complimentary to the profile desired for the plate edge.

Figure 4:
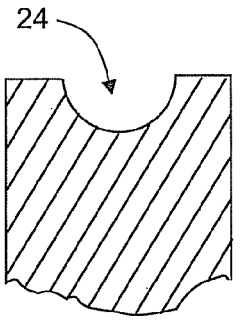
FIG. 4 is a cross sectional side view of a formed abrasive wheel.

Formed wheels, such as that depicted in FIG. 4, are difficult to make when a small tight radius is required for the recessed region in the grinding surface. Formed wheels are typically made using electrical discharge machining (EDM), and the tool used to create this form often wears quickly, creating a blunt shape at the bottom of the resultant groove. This wear is not desirable for producing a finished final shape on the edges of a thin glass plate. In comparison, a wheel having a flat contact (i.e. abrasive) surface according to embodiments of the present invention maintains its shape for a much longer period of time due to a significant increase in abrasive surface area contacting the glass plate.

Typically, grinding surface 22 comprises diamond particulate as a cutting medium dispersed in a suitable matrix or binder (e.g. resin or metal bond matrixes). Good results have been obtained with 600 mesh diamond particulate, although particulate sizes ranging from 300 mesh through 1000 mesh have also been successfully demonstrated. Other cutting mediums may also be used, such as carbide particulate. Abrasive wheel 18 is mounted to a rotatable shaft 26, such as the shaft of an electric motor, the shaft comprising an axis of rotation 28 about which the abrasive wheel is rotated. Since there is a significant increase in abrasive surface area being applied to the glass plate with an abrasive cup wheel as described above when compared to a formed wheel, the abrasive cup wheels are more cost effective from the perspective of grinding medium used to the amount of glass that is ground. More simply, an abrasive cup wheel makes more efficient use of the grinding medium by applying more of the grinding medium to the task of grinding than a formed wheel design. Also, since a larger surface area is used with abrasive wheels having a flat contact surface, these wheels can last much longer than formed wheels. This may not only decrease yearly abrasive wheel cost but may also reduce production cost since line downtime associated with abrasive cup wheel changes can be significantly less frequent than formed wheel changes.

FIG. 2A also shows glass plate 14 supported by support member 16 such that a portion 30 of glass plate 14 extends beyond the support member. For example, the glass plate may be positioned in a horizontal arrangement as shown, wherein the glass sheet may be said to be cantilevered from the support member. However, glass plate 14 may be fixtured in any orientation, at any angle. For example, glass plate 14 may be supported in a vertical orientation. Apparatus 10 may further comprise clamping member 31 comprising a rail, fingers, hooks or other suitable clamping members to secure glass plate 14 to support 16. Another method of securing the plate is by including a vacuum chuck into the support that holds the glass plate stationary. A vacuum may be used alone or in combination with one or more clamping members. Generally, any suitable method of securing glass plate 14 to support 16 may be used as long as a portion of the glass plate is positioned to extend from the fixture (e.g. support 16 and clamp 31), and the extending portion is free to flex relative to the fixture while the glass plate is nevertheless firmly attached. The plate is secured to the fixture such that extending portion 30 extends a predetermined distance L from the fixture. The distance L may vary, depending on the position along an edge of the glass plate from which L is measured, as described more fully farther below.

Figure 2B:
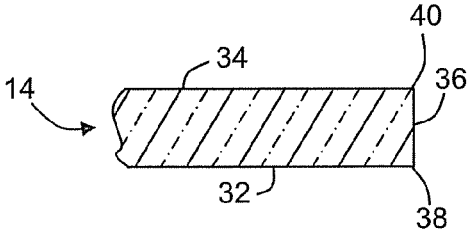
FIG. 2B is a cross sectional side view showing a close up of the edges of the glass plate of FIG. 2A.

Referring still to FIG. 2A, glass plate 14 comprises first major surface 32, second major surface 34, and end surface 36 (see FIG. 2B showing a portion of glass plate 14) disposed between and intersecting with the first and second surfaces along first and second edges, respectively. Referring now to FIGS. 2A, 2B, 5 and 6, first abrasive cup wheel 18*a* is positioned so that the flat grinding surface of the abrasive wheel forms a first angle α relative to end surface 36 (FIG. 5) and is in contact with first edge 38 (FIG. 2B) located between first surface 32 and end surface 36. Second abrasive cup wheel 18*b* is positioned so that the grinding surface of abrasive wheel 18*b* forms a second angle β relative to end surface 36 and is in contact with second edge 40. First and second angles α, β are preferably, but not necessarily, equal.

Figure 6:
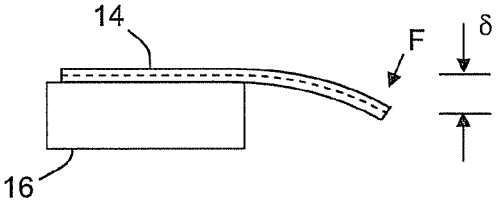
FIG. 6 is a cross sectional side view of a glass plate, such as the glass plate of FIG. 2A, comprising a portion that extends from the fixturing device, and showing the deflection that occurs when a force is applied to the end of the glass plate.

First abrasive wheel 18*a* is rotated about axis of rotation 28*a* and acts on first surface 32 with a force $F_1$. This force $F_1$ in turn produces a deflection $\delta_1$ in glass plate 14. That is, glass plate 14 bends in response to the applied force. This can be seen generically with the aid of FIG. 6, showing a force F applied to glass plate 14, thereby eliciting a response in the form of a deflection S. The amount of bending, or compliance (the magnitude of δ), is a function of many variables, including material properties of the glass (e.g. Young's modulus) the amount of extension from the fixture, and the magnitude of the force. These variables can be lumped, and characterized by a stiffness value k, where stiffness is equal to the applied force divided by the resulting magnitude of deflection. The stiffness k can be expressed in general as $$k = \frac{F}{\delta} \propto \frac{EI}{L^3}$$

where force F divided by deflection δ is also proportional to the elastic modulus of the glass plate multiplied by the moment of inertia and divided by the amount of extension of the glass plate beyond the fixture to the third power.

It can also be shown that the amount of material removed by an abrasive wheel is directly proportional to the applied force. From the above equation it can be seen that a plate fully supported by a rigid support, with no extended portion and no deflection in a plane of the glass plate in the presence of an applied force, the stiffness is infinite. In this instance, an increase in force, such as the force applied by an abrasive wheel on a glass plate, will result in a commensurate increase in the amount of material removed, and therefore an increase in the bevel width. Such a system becomes unattractively sensitive to small variations in the position of the grinding wheel as are often observed in a real life system. This sensitivity can be as high as 1:1, wherein a doubling in the applied force results in a doubling of the material removed.

On the other hand, the relationship above also suggests that if a portion of the plate is extended past the fixture (e.g. beyond support 16), the stiffness of the extended portion is reduced and finite and the plate may flex. For a low, finite stiffness, this compliance results in a reduced bevel width. In other words, the deflection resulting from small positional variations of an abrasive wheel in contact with a plate having low stiffness (exhibiting compliance) can avoid large increases in material removed when compared to the same positional movement relative to a rigid plate (e.g. high stiffness). Additionally, the precision level of the beveling apparatus need not be as high as would be necessary if the glass plate did not exhibit compliance. This may reduce equipment costs, since, for example, bearing precision may be relaxed.

In accordance with embodiments of the present invention, a plurality of abrasive wheels are used to produce a chamfer or bevel on both edges of an end of a glass plate constrained by a fixturing device and wherein the glass plate includes a portion thereof that extends beyond the fixturing device. At least two abrasive wheels are deployed, and arranged so that each of the at least two abrasive wheels engage an end of the glass plate on opposite sides of the glass plate. Each wheel is rotated about an axis of rotation and traversed along the end of the glass plate so that double bevels are formed along the end of the glass plate.

Figure 5:
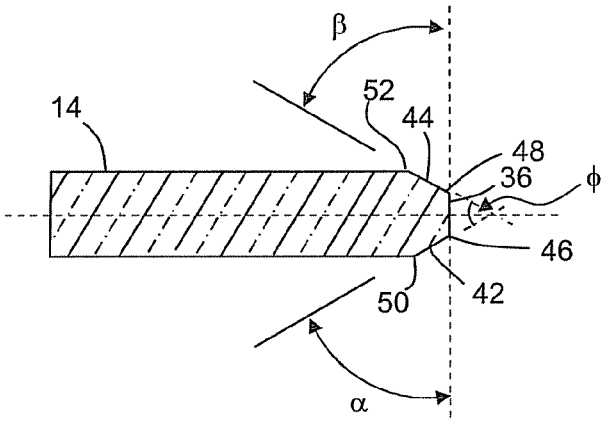
FIG. 5 is a cross sectional side view of a portion of the glass plate of FIG. 2A showing the edges of the glass plate after beveling, and indicating the angular relationship of the grinding surfaces of the abrasive wheels.

For example, a bevel is formed by abrasive wheel 18*a* along first edge 38 of glass plate 14. Preferably, angle α of the bevel relative to the plane of end surface 36 is about 60 degrees, although good results have been seen with angles between and inclusive of 20 to 70 degrees (FIG. 5). Abrasive wheel 18*b* similarly produces a second bevel at second edge 40, with bevel angle β preferably being about 60 degrees. But again, angles between and inclusive of 20 to 70 degrees have been shown to be acceptable. This creates an intermediate shape at as shown in FIG. 5 comprising first and second major surfaces 32 and 34, end surface 36, and bevel surfaces 42 and 44. Bevel surfaces 42 and 44 intersect end surface 36 along third and fourth edges 46 and 48, respectively. Bevel surfaces 42 and 44 also intersect first and second major surfaces 32, 34 along fifth and sixth edges 50 and 52, respectively. "Included" angle ϕ formed by the planes of the two bevel surfaces is preferably in the range between 40 degrees and 140 degrees.

Figure 7:
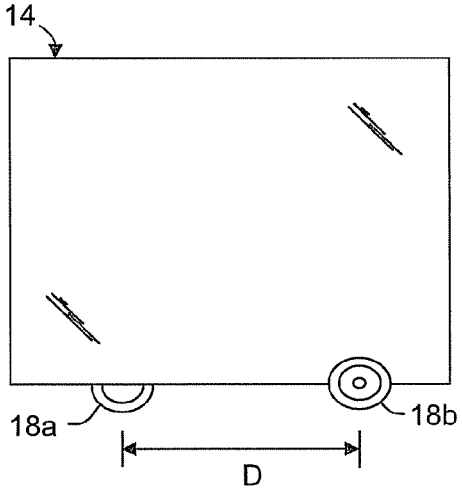
FIG. 7 is an overhead view of the glass plate of FIG. 2A, showing the two abrasive cup wheels, wherein the axes of rotation of the abrasive cup wheels are separated by a distance D.

To isolate the effects of abrasive cup wheels 18*a* from 18*b*, the axes of rotation 28*a*, 28*b* of first and second cup wheels 18*a*, 18*b*, respectively, are spaced apart a predetermined distance D as depicted in FIG. 7. The magnitude of this pre-determined distance is selected so that the force applied by one cup wheel against glass sheet 14 does not influence the action of the other cup wheel. That is, the deflection from a plane of the glass plate produced by one cup wheel does not cause a deflection in the glass plate within the region of influence of other cup wheel. Put perhaps more simply still, the deflection from a plane of the glass plate produced by one abrasive cup wheel preferably does not overlap the deflection produced by the other cup wheel.

Figure 8:
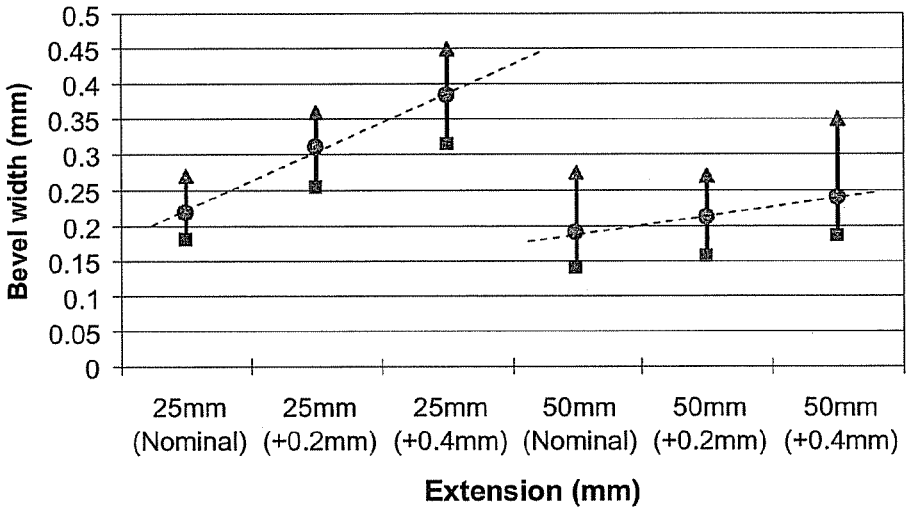

The amount of material removed, or the bevel width, is used to gage the performance of the grinding operation. FIG. 8 shows the average (circles) and range between min and max (distance between the triangle and square for each average data point) of bevel width for two different nominal extension amounts, 25 mm (left) and 50 mm (right). For the smaller nominal extension distance of L=25 mm, the bevel width increases with an increase in the Z-axis machine position (depth of cut). That is, as the wheel is brought closer to the sheet. A similar study for L=50 mm indicates that the variation in bevel width for an increase in depth of cut is smaller than the increase for the 25 mm extension sample.

Figure 9:
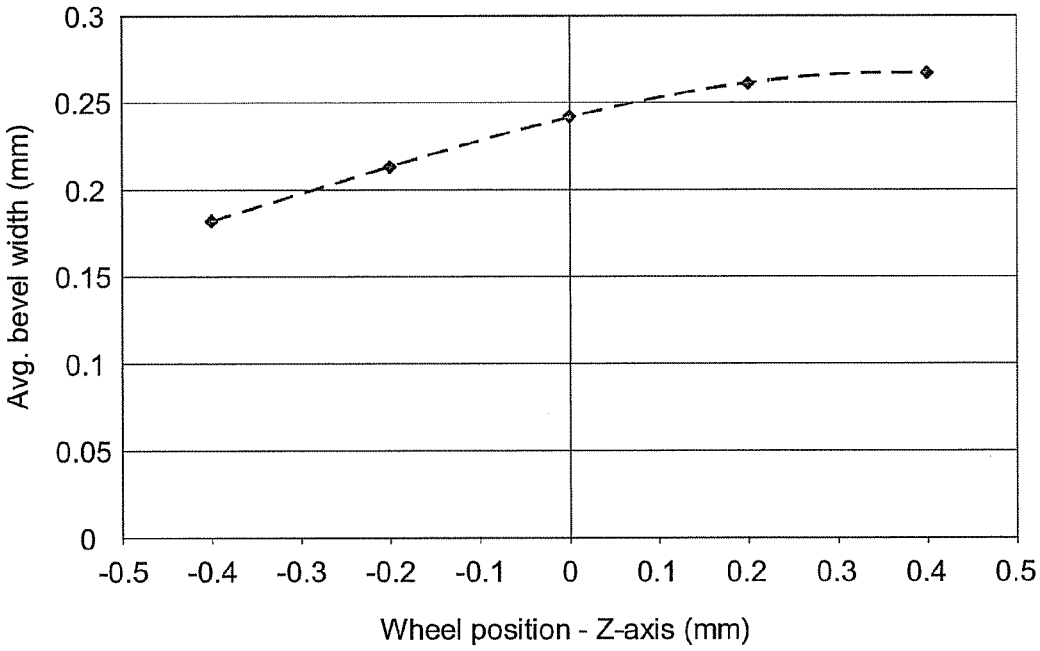
FIG. 9 is a plot of the average bevel width as a function of the position of an abrasive cup wheel as the cup wheel position is varied from a nominal position on a glass plate having an extension of 25 mm.

FIG. 9 shows a non-linearity in the amount of glass material removed with change in depth of cut (machine Z-axis). As the wheel position changes along the Z axis (perpendicular to the major surfaces of the glass plate) relative to a nominal position, the deflection varies nonlinearly. This occurs because there is a change in the glass stiffness as the applied load (grinding force) varies. A point may be eventually reached where too much force applied to the glass by the abrasive wheel will either cause the glass to fail (break) or will cause the glass to disengage from the support (e.g. vacuum chuck).

It will be understood by one skilled in the art that a similar set of circumstances described above can be depicted for second abrasive wheel 18*b*. That is, considering second abrasive wheel 28*b* in contact with second edge 40 and applying a force $F_2$. However, since $F_2$ is applied in a direction opposite that for $F_1$, displacement of the extended portion of the glass sheet occurs in a direction opposite to the deflection produced by the first abrasive wheel.

While one embodiment comprises beveling first one edge and then the other, the process is less efficient than beveling both edges simultaneously. However, because the force applied to the extended portion by each abrasive cup wheel causes a deflection in the extended portion that is opposite for each of the first and second abrasive cup wheels, it is desirable to separate the cup wheels so that the deflection caused by one cup wheel does not influence the grinding by the other cup wheel. In other words, the axes of rotation of the abrasive cup wheels should be separated by a distance D such that at least a portion of the glass between the cup wheels is substantially undeflected.

Figure 10:
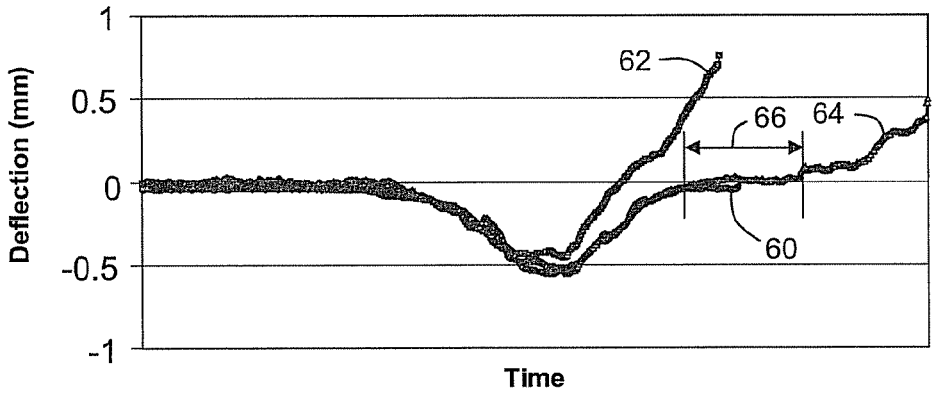
FIG. 10 is a plot of deflection as a function of time for three scenarios: when a single force is applied by a single abrasive wheel in contact with a glass plate; when two abrasive wheels separated by an inadequate distance come into contact with the glass plate, and; when two abrasive wheels separated by an adequate distance come into contact with the glass plate wherein the deflection of the first abrasive wheel does not overlap with the deflection caused by the second abrasive wheel.

FIG. 10 shows deflection measurements for three scenarios: 1) displacement of the glass plate as a single abrasive wheel performs the grinding operation (curve 60); 2) displacement of the glass plate when two abrasive wheels having their axes of rotation separated by 190 mm perform the grinding operation (curve 62); and displacement of the glass plate when two abrasive wheels having their axes of rotation separated by 310 mm perform the grinding operation (curve 64). The flat portion 66 of curve 64 indicates no interaction between the two wheels. That is, the displacements produced by the wheels are separate and distinct from one another, and do not intersect. The flat region 66 between the two deflections is a region of no deflection. Preferably, the distance D between the two axes of rotation 28*a* and 28*b* is equal to or greater than 250 mm, and more preferably equal to or greater than 310 mm.

Figure 11:
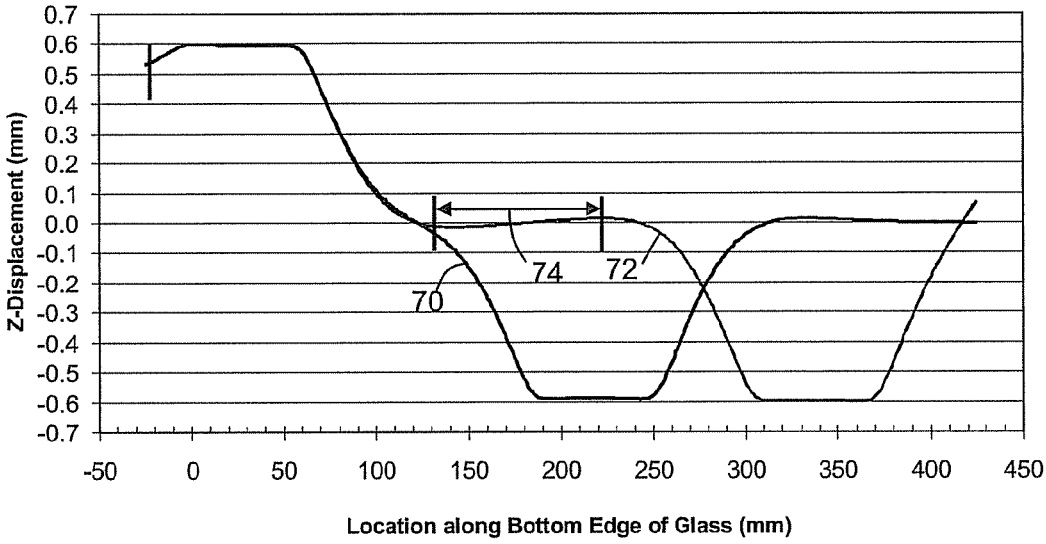
FIG. 11 depicts modeling results showing the effects of deflection cause by contacting a glass plate with two abrasive wheels, wherein when the wheels are too close, the deflection cause by one wheel overlaps the deflection caused by the other wheel; and wherein the abrasive wheels are separated by a distance such that the deflection cause by one abrasive wheel does not overlap the deflection caused by the other abrasive wheel.

FIG. 11 illustrates modeling results for two different scenarios. In the first scenario, represented by curve 70, first one abrasive wheel engages with the glass plate, followed by later engagement of the second abrasive wheel. The axis of rotation of the first abrasive wheel is separated from the axis of rotation of the second abrasive wheel by a distance L of 190 mm. The curve shows that before the deflection of the glass plate due to contact between the first and second abrasive wheels flow into each other. That is, the deflection due to one abrasive wheel is influenced by the deflection of the other abrasive wheel. Curve 72 depicts a situation where the axis of rotation of the two wheels are separated by 310 mm. The substantially flat portion 74 indicates that the defection produced by one wheel is not influenced by the deflection of the other wheel.

Figure 12:
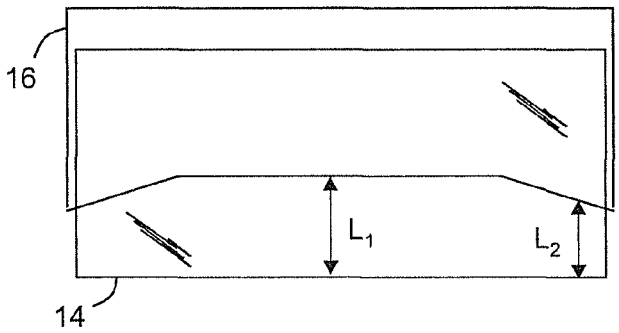
FIGS. 12 and 13 depict overhead views of a glass plate supported by a support, wherein an edge of the support is nonlinear and the extension distance varies
Figure 13:
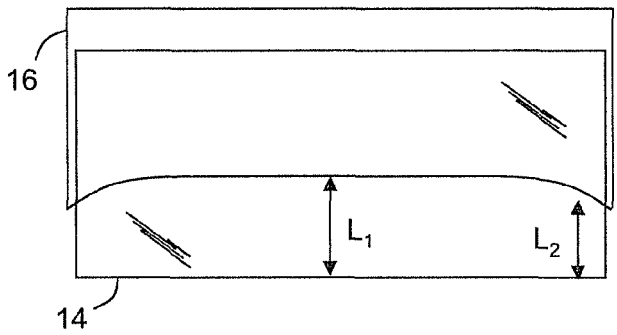

In another embodiment the shape of the support may be altered to reflect the fact that the stiffness at the corners of the glass plate is less than the stiffness of the plate in the central region of the plate. This can be easily understood by noting that a point at the corner of the plate has glass only to one side and not the other. The same can be said for the opposite corner at the other end of an edge, except that the lack of glass is one the opposite side than the first corner. The result is that an abrasive wheel set for pre-determined position relative to the glass plate (i.e. set for a pre-determined grinding depth) will remove more material from the central region of the glass plate edge than at the corners of the glass plate edge. This occurs in part because the corner regions flex more, and may in fact exhibit curling. To maintain a constant stiffness and consistent material removal along the length of the edge, it may be necessary to alter one of the variables upon which stiffness depends. One can, if desired, vary the position of the abrasive wheel as the wheel traverses over a given edge. Alternatively, the shape of support member 16 may be varied so that the extension L of the glass plate varies along the edge. In this case, L should be reduced proximate the corners of the glass plate, reducing L at those points, and effectively increasing the stiffness of the plate in those regions. For example, FIG. 12 shows a top down view of glass sheet 14 secured to support 16, wherein support 16 comprises a nonlinear edge adjacent to extended portion 30 of glass plate 14 that reduces L in predetermined regions of the plate. The edge of the support may include a plurality of straight line segments joined at angles to effect different extension lengths between a center portion of the glass plate (e.g. $L_1$) and an end portion (e.g. $L_2$), as depicted in FIG. 12, or the edge may comprise curved portions as shown in FIG. 13, again affecting different extension lengths.

Figure 14:
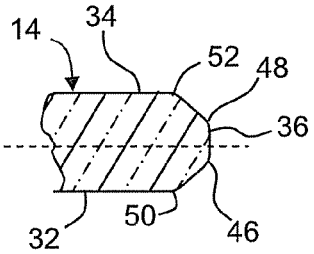
FIG. 14 is a cross sectional side view of the beveled edges of a glass plate after polishing.

Additionally, once bevels have been produced on the glass plate, the resulting additional edges (46, 48 and 50, 52) may be further polished to eliminate the sharp corner at those edges and form arcuate edges (see FIG. 14). This may be accomplished, for example, with a buffing wheel and suitable abrasive paste.

It should be emphasized that the above-described embodiments of the present invention, particularly any "preferred" embodiments, are merely possible examples of implementations, merely set forth for a clear understanding of the principles of the invention. Many variations and modifications may be made to the above-described embodiments of the invention without departing substantially from the spirit and principles of the invention. All such modifications and variations are intended to be included herein within the scope of this disclosure and the present invention and protected by the following claims.

What is claimed is:

1. A method of shaping the edge of a glass plate comprising:

coupling a glass plate to a support fixture, a portion of the glass plate extending from the support fixture a distance L and comprising a first surface, an second surface opposing the first surface and an end surface, and wherein the first surface and the end surface intersect along a first edge and the second surface and the end surface intersect along a second edge;

contacting the first edge with a first abrasive cup wheel rotating about a first axis of rotation angled relative to the first surface, wherein the first abrasive cup wheel contacts the first edge with a first force $F_1$ that produces a first deflection $\delta_1$ of the extended portion;

contacting the second edge of the glass plate with a second abrasive cup wheel rotating about a second axis of rotation angled relative to the second surface and spaced apart from the first abrasive cup wheel axis of rotation by a distance D equal to or greater than 220 mm, the second abrasive cup wheel contacting the second edge with a second force $F_2$ that produces a second deflection $\delta_2$ of the extended portion opposite from $\delta_1$, and wherein the second abrasive cup wheel contacts the second edge simultaneous with the first abrasive cup wheel contacting the first edge;

producing relative motion between the first and second abrasive cup wheels and the glass plate during the contacting of the first and second abrasive cup wheels with the first and second edges, respectively; and wherein the first deflection does not overlap the second deflection.

2. The method according to claim 1, wherein there is no relative motion between the first and second abrasive cup wheels during the contacting of the first and second abrasive cup wheels with the first and second edges, respectively.

3. The method according to claim 1, wherein D is equal to or greater than 275 mm.

4. The method according to claim 1, wherein L is equal to or greater than 5 mm.

5. The method according to claim 1, wherein L is in the range between about 15 and 50 mm.

6. The method according to claim 1, wherein the rotating first and second abrasive cup wheels produce first and second bevel surfaces, respectively, the first bevel surface intersecting the end surface along a third edge and the second bevel surface intersecting the end surface along a fourth edge, and further comprising polishing the glass plate to produce arcuate third and fourth edges.

7. The method according to claim 1, wherein L varies relative to a location along the first or second edge.

8. The method according to claim 1, wherein the support fixture comprises an edge proximate the extended portion from which the extended portion extends, and the support fixture edge comprises a nonlinear shape.

9. The method according to claim 1, wherein a distance between the first abrasive cup wheel and the first edge is varied, respectively, to maintain a constant bevel width.

10. A method of shaping the edge of a glass plate comprising:

coupling a glass plate having a thickness equal to or less than 2 mm to a support fixture, a portion of the glass plate extending from the support fixture a distance L and comprising a first surface, an second surface opposing the first surface and an end surface, wherein the first surface and the end surface intersect along a first edge and the second surface and the end surface intersect along a second edge;

contacting the first edge with a first abrasive cup wheel rotating about a first axis of rotation angled relative to the first surface, wherein the first abrasive cup wheel contacts the first edge with a first force $F_1$ that produces a first deflection in the extended portion;

contacting the second edge of the glass plate with a second abrasive cup wheel rotating about a second axis of rotation angled relative to the second surface and spaced apart from the first abrasive cup wheel axis of rotation by a distance D greater than or equal to 220 mm, the second abrasive cup wheel contacting the second edge with a second force $F_2$ that produces a second deflection in the extended portion opposite in direction from the first deflection, and wherein the second abrasive cup wheel contacts the second edge simultaneous with the first abrasive cup wheel contacting the first edge;

producing relative motion between the first and second abrasive cup wheels and the glass plate during the contacting of the first and second abrasive cup wheels with the first and second edges, respectively, to produce bevels at the first and second edges; and wherein the extended portion extends a distance L equal to or greater than 25 mm from the support fixture and D is selected such that the first deflection does not overlap the second deflection.

11. The method according to claim 10, wherein an included angle formed by the intersection of the planes of the bevels is between 40 and 140 degrees.

12. The method according to claim 10, further comprising polishing additional edges formed as a result of producing the bevels.

13. The method according to claim 10, wherein L varies as a function of position along the first or second edge.

14. The method according to claim 10, wherein L is in the range between 5 mm and 50 mm.

15. An apparatus for grinding a glass plate comprising substantially parallel major surfaces and at least one end surface intersecting the major surfaces along substantially parallel first and second edges, the apparatus comprising:

first and second grinding wheels comprising substantially flat grinding surfaces, wherein the grinding surfaces are positioned at angles relative to the end surface of the glass plates to produce a bevel along each of the first and second edges of the glass plate, the first and second grinding wheels configured to rotate about first and second axes of rotation, respectively;

a support member that supports the glass plate so that a portion of the glass plate extends beyond the support member and allows the glass plate to flex in response to contact with the first and second edges by the first and second grinding surfaces, respectively, the extended portion comprising the first and second edges; and wherein the first and second axes of rotation are separated by a distance equal to or greater than 220 mm such that a deflection of the extended portion of the glass plate resulting from contact between the first grinding surface and the first edge does not affect deflection of the extended portion of the glass plate resulting from contact between the second grinding surface and the second edge, and wherein the contact between the first and second grinding surfaces and the first and second edges is concurrent.

16. The apparatus according to claim 15, wherein the support member comprises an edge proximate to the extended portion from which the extended portion extends, and the support fixture edge comprises a non-linear shape such that the distance the extended portion extends from the support varies as a function of location along a length of the first or second edge.

17. The apparatus according to claim 15, wherein the glass plate is supported in a manner such that a stiffness of the extended portion varies as a function of location along a length of the first or second edge.

18. The apparatus according to claim 15, wherein the support member comprises a vacuum chuck.

19. An apparatus for grinding a glass plate comprising substantially parallel major surfaces and at least one end surface intersecting the major surfaces along substantially parallel first and second edges, the apparatus comprising:

first and second grinding wheels comprising substantially flat grinding surfaces, wherein the grinding surfaces are positioned at angles relative to the end surface of the glass plates to produce a bevel along each of the first and second edges of the glass plate, the first and second grinding wheels configured to rotate about first and second axes of rotation, respectively;

a support member that supports the glass plate so that a portion of the glass plate extends beyond the support member and allows the glass plate to flex in response to contact with the first and second edges by the first and second grinding surfaces, respectively, the extended portion comprising the first and second edges, and the support member comprises an edge proximate to the extended portion from which the extended portion extends, and the support fixture edge comprises a non-linear shape such that the distance the extended portion extends from the support varies as a function of location along a length of the first or second edge; and wherein the first and second axes of rotation are separated by a distance such that a deflection of the extended portion of the glass plate resulting from contact between the first grinding surface and the first edge does not affect deflection of the extended portion of the glass plate resulting from contact between the second grinding surface and the second edge, and wherein the contact between the first and second grinding surfaces and the first and second edges is concurrent.

* * * * *